US006679240B1

(12) United States Patent
Hurd

(10) Patent No.: US 6,679,240 B1
(45) Date of Patent: Jan. 20, 2004

(54) BOW-ATTACHED, ARROW LAUNCHING APPARATUS

(76) Inventor: David L. Hurd, Rte. 3, Box 789-A, Tazewell, VA (US) 24651

( * ) Notice: Subject to any disclaimer, the term of this patent is extended or adjusted under 35 U.S.C. 154(b) by 0 days.

(21) Appl. No.: 10/288,061

(22) Filed: Nov. 5, 2002

(51) Int. Cl.[7] ..... F41B 5/00

(52) U.S. Cl. ..... 124/24.1; 124/35.2; 124/88; 473/578

(58) Field of Search ..... 124/23.1, 24.1, 124/25, 25.5, 88, 35.2; 473/578, 582, 585, 586

(56) References Cited

U.S. PATENT DOCUMENTS 4,027,645 A * 6/1977 Damron ..... 124/24.1
4,874,180 A * 10/1989 Fingerson et al. ..... 473/578
5,150,700 A * 9/1992 Troncoso ..... 124/44.5
5,156,138 A * 10/1992 Grover ..... 124/35.2
5,261,383 A * 11/1993 Halamay ..... 124/44.5
5,311,855 A * 5/1994 Basik ..... 124/44.5
5,520,163 A * 5/1996 Hurd ..... 124/24.1
5,553,597 A * 9/1996 Sparks ..... 124/44.5
5,671,723 A * 9/1997 Goff et al. ..... 124/35.2
5,769,065 A * 6/1998 Hurd ..... 124/24.1
6,375,586 B1 * 4/2002 Cousins et al. ..... 473/578
6,513,511 B1 * 2/2003 Garthe et al. ..... 124/25.6
6,558,280 B1 * 5/2003 Kuhn ..... 473/578

* cited by examiner

*Primary Examiner*—Kien T. Nguyen

(57) ABSTRACT

An arrow launching apparatus is provided for attachment to a bow handle and includes launcher-to-bow-handle attachment assembly connected to the bow handle. A launcher assembly is connected to the launcher-to-bow-handle attachment assembly. The launcher assembly includes a guide member assembly and a carriage block supported on the guide member assembly, and the carriage block rides along the guide member assembly. The carriage block includes a bow-string-reception channel for receiving a bow string. Carriage block hold and release assembly are supported on the guide member assembly and provide for selectively preventing or permitting travel of the carriage block along the guide member assembly. Use of the apparatus permits a user to use both hands when aiming and shooting an arrow. The apparatus also permits use of shorter-than-conventional-length arrows.

22 Claims, 5 Drawing Sheets

10
32
2
2
13
80
54
30
28
50

32
50
80
3
84
26
28
17
20
35
24
30
34
22
18
3

FIG 5
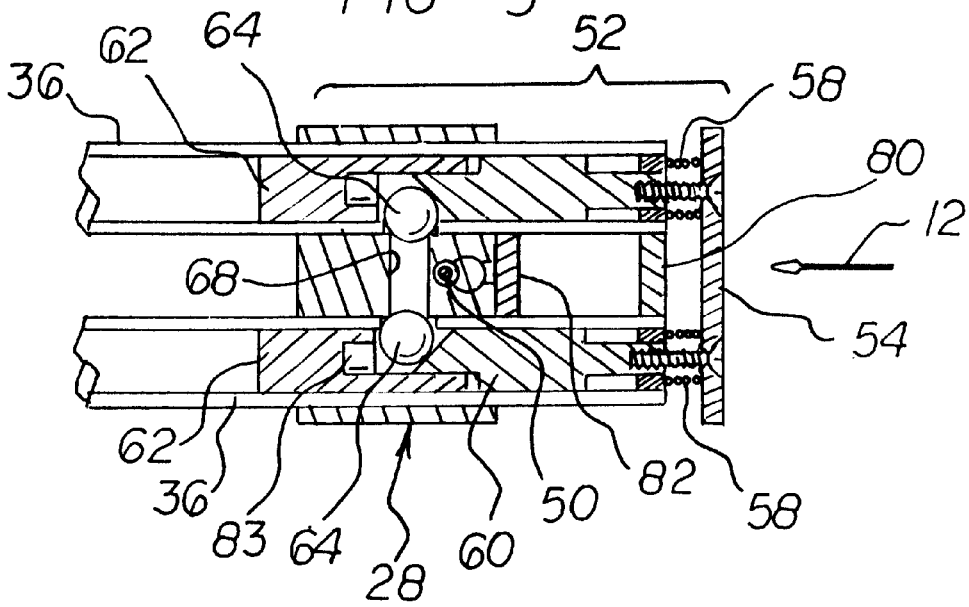
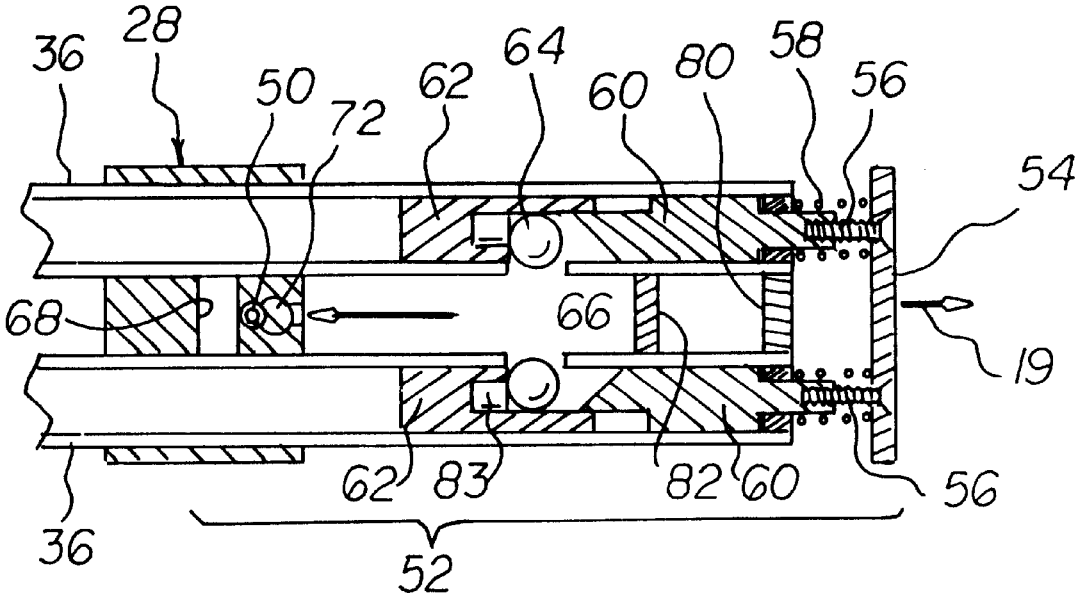
FIG 6

FIG 9
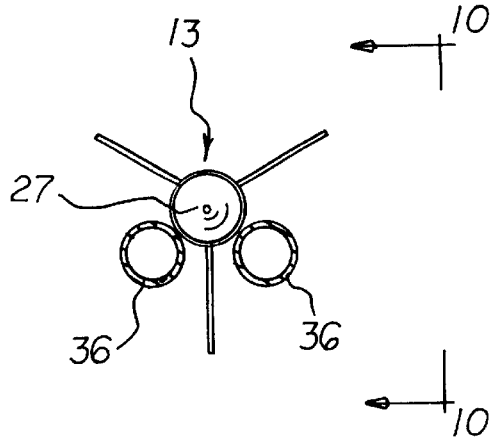
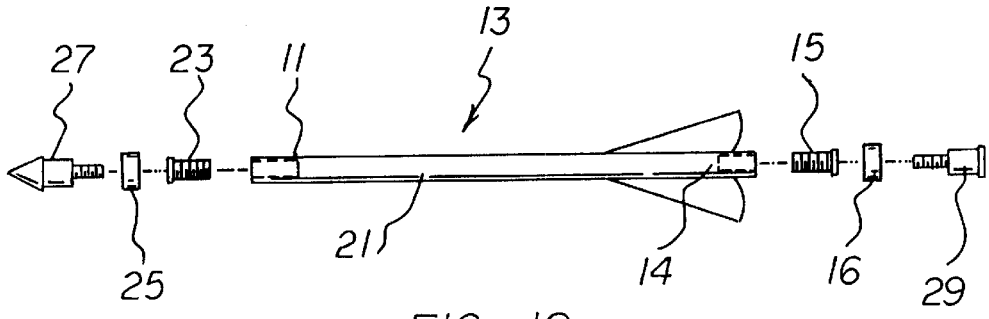
FIG 10

BOW-ATTACHED, ARROW LAUNCHING APPARATUS

BACKGROUND OF THE INVENTION

1. Field of the Invention

The present invention relates generally to archery bows and arrows and, more particularly, to an attachment to a bow especially adapted for launching arrows.

2. Description of the Prior Art

The invention described herein is an improvement of the bow-attached, arrow launching apparatus by the same inventor, David L. Hurd, and disclosed in U.S. Pat. No. 5,769,065, incorporated herein by reference and disclosed in U.S. Pat. No. 5,520,163, incorporated herein by reference.

The present invention continues to retain the combination of desirable features set forth in U.S. Pat. No. 5,769,065 and in U.S. Pat. No. 5,520,163. More specifically, with the present invention, the following combination of desirable features are retained: (1) can employ arrows that are shorter than conventional length; (2) provides a bow and bow string that can be sufficiently stretched to effectively propel a shorter-than-conventional-length arrow; (3) is able to readily convert a conventional bow into a novel bow that can be employed to launch shorter-than-conventional-length arrows; (4) provides arrows which permit the arrows to propelled by a bow string without employing a slot or nock at the rear ends of the arrows; (5) permits pulling back the rear end of an arrow and the bow string without using a pinching and pulling action on the rear end of the arrow; (6) provides a track for launching a shorter-than-conventional-length arrow wherein the track has a relatively short length for storage purposes; (7) provides a launching device for a shorter-than-conventional-length arrow that can be employed with a vertically oriented bow; (8) provides a bracket member can be used as a support for a plurality of arrows; (9) provides a magnetic attraction between the back of an arrow and a bow string guide assembly so that the arrow is retained in the launcher assembly until it is launched off of the launcher assembly; and (10) providing rapid speed in loading and shooting an arrow by utilizing the proximity of the bracket for supporting a plurality of arrows and the launcher assembly and by utilizing the magnetic attraction between the back of an arrow and a bow string guide assembly.

Still other features would be desirable in a bow-attached, arrow launching apparatus and are provided by the present invention. For example, in U.S. Pat. No. 5,769,065, the bow string guide assembly 30 is pulled back to tension the bow string. To launch the arrow, the bow string guide assembly 30 is released. As long as the bow string guide assembly 30 is held by the user, the bow and arrow are essentially supported by two hands of the user. Such a two-hand support is very stable. However, when the user releases the bow string guide assembly 30 to launch the arrow, one hand of the user is released from the bow string guide assembly 30, and during launching of the arrow, the bow and arrow apparatus is supported by only one hand of the user. Such a one-handed support of the bow and arrow apparatus during launch of the arrow can result in unstable launch conditions which can impede accuracy. In this respect, it would be desirable if a bow-attached, arrow launching apparatus were provided which permits an arrow to be launched while the bow and arrow are supported by two hands of the user.

In U.S. Pat. No. 5,769,065, when the bow string guide assembly 30 is pulled back to tension the bow string, as long as the user takes aim before launching the arrow, the user must maintain full tension on the bow string. This may be fatiguing, especially if a relatively long period of time is needed to take a careful aim. In this respect, it would be desirable if a bow-attached, arrow launching apparatus were provided which enabled a bow string guide assembly 30 to be held in a string-tensed position without the need for a user to maintain full tension on the bow string.

In U.S. Pat. No. 5,769,065, the launcher assembly has front telescopic segments 33 and rear-end guide track assemblies 68. To avoid any possible translation between the front and rear telescopic members, it would be desirable if front guide members and rear guide members were provided which are connected together in a rigid, non-telescopic manner. In this respect, it would be desirable if assembly of front guide members and rear guide members from a storage condition could be carried out rapidly and securely. In this respect, it would also be desirable if disassembly of front guide members and rear guide members from an in-use condition to a storage condition could be carried out rapidly.

In addition to the desirable features mentioned above provided by U.S. Pat. No. 5,769,065 and by U.S. Pat. No. 5,520,163, the present improvement provides the following additional desirable features: (1) permits an arrow to be launched while the bow and arrow are supported by two hands of the user; (2) enables a bow string guide assembly to be held in a string-tensed position without the need for a user to maintain full tension on the bow string; (3) provides front guide members and rear guide members which are connected together in a rigid, non-telescopic manner; (4) permits assembly of front guide members and rear guide members from a storage condition to be carried out rapidly and securely; and (5) permits disassembly of front guide members and rear guide members from an in-use condition to a storage condition to be carried out rapidly. The foregoing desired characteristics are provided by the unique bow-attached, arrow launching apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an arrow launching apparatus for attachment to a bow handle and includes launcher-to-bow-handle attachment means connected to the bow handle. A launcher assembly is connected to the launcher-to-bow-handle attachment means. The launcher assembly includes a guide member assembly and a carriage block supported on the guide member assembly, and the carriage block rides along the guide member assembly. The carriage block includes a bow-string-reception channel for receiving a bow string. Carriage block hold and release assembly means are supported on the guide member assembly and provide for selectively preventing or permitting travel of the carriage block along the guide member assembly.

Preferably, the guide member assembly includes threaded studs for attachment to the launcher-to-bow-handle attachment means.

Preferably, the launcher-to-bow-handle attachment means include a mounting bar which includes at least one bow-handle-fastener reception channel and two threaded stud reception and adjustment slots. A bow-handle-received fastener is threaded through the bow-handle-fastener reception channel for mounting the mounting bar onto the bow handle.

Thumb nuts are used for attachment to the threaded studs of the guide member assembly which are passed through the threaded stud reception and adjustment slots, for securing the threaded studs to the mounting bar.

Preferably, the guide member assembly includes a first guide member unit connected to the launcher-to-bow-handle attachment means, a distal end bridging and carriage stopping member connected to the first guide member unit, and a second guide member unit connected to the distal end bridging and carriage stopping member. The second guide member unit and the first guide member unit are parallel to each other.

Preferably, the first guide member unit includes the threaded studs for connection to the launcher-to-bow-handle attachment means.

Preferably, the carriage block hold and release assembly means are supported on the respective guide member units, for selectively holding and releasing the carriage block on the respective guide member units.

Preferably, the first guide member unit includes a first front guide member, a rear guide member, and front-to-rear-guide connecting means for connecting the rear guide member to the first front guide member. Preferably, the second guide member unit includes a second front guide member, a rear guide member, and front-to-rear-guide connecting means for connecting the rear guide member to the second front guide member. The first front guide member, the second front guide member, and the rear guide members have substantially the same outer diameter.

Preferably, a reinforcement member is connected between the first guide member unit and the second guide member unit to stabilize the relationship between the two guide units and to maintain in a parallel relationship.

Preferably, the threaded studs, the first front guide member, the distal end bridging and carriage stopping member, the second front guide member, and the reinforcement member form a unified, integrated guide track front assembly.

Preferably, the front-to-rear-guide connecting means include a guide member longitudinal insert received in the first front guide member and in a rear guide member for connecting the rear guide member to the first front guide member. Also, another guide member longitudinal insert is received in the second front guide member and in another rear guide member for connecting the other rear guide member to the second front guide member. Front-member-to-insert locking means are provided for locking the guide member longitudinal inserts to the respective front guide members.

Preferably, the guide member longitudinal inserts, the rear guide members, the carriage block, and the carriage block hold and release assembly can be formed as a unified, integrated guide track rear extension assembly.

Preferably, the front-member-to-insert locking means include front set screw access openings in the respective first front guide member and the second front guide member. Front guide member set screws are received in the guide member longitudinal inserts and are accessed through the front set screw access opening. One front guide member set screw is used to engage the first front guide member, and a second front guide member set screw is used to engage the second front guide member.

Preferably, arrow retention means are provided in the carriage block. The arrow retention means include a magnet member for engaging a ferro-magnetic rear end of an arrow.

Preferably, the carriage block hold and release assembly means include a carriage block hold and release assembly mounted on the guide member assembly and include a carriage holding element reception portion present on the carriage block. The guide member assembly includes a first guide member unit and a second guide member unit, and each respective guide member unit includes a block holding element entry/exit passageway.

Preferably, the carriage block hold and release assembly includes a pair of block holding element stops received in the respective guide member units, positioned distal to the block holding element entry/exit passageways. A pair of block holding elements are placed adjacent to block holding element entry/exit passageways within the guide member units. A pair of plunger wedges are received in the guide member units, and the plunger wedges are positioned proximal to the block holding element entry/exit passageways. A thumb plate is connected to ends of the plunger wedges, and the thumb plate is positioned outside the guide member units. A finger hold is connected to the guide member units in proximity of the thumb plate. Plunger puller springs are positioned between the thumb plate and the guide member units, providing a spring bias for pulling the plunger wedges in a direction away from the block holding element stops. A bridging and carriage stop member is connected to the guide member units between the finger hold and the block holding element entry/exit passageways. The carriage stop member limits backward motion of the carriage block along the guide member units. A pair of block holding elements are positioned between the block holding element stops and the plunger wedges adjacent to the block holding element entry/exit passageways.

In addition, holding-element-retainer magnets are located in the block holding element stops adjacent to the block holding elements for attracting the block holding elements thereto and for holding the block holding elements against the holding-element-retainer magnets.

Preferably, the carriage block includes guide-member-reception channels for receiving the guide member assembly. A magnet-reception well is provided in the carriage block, and a magnet member is received in the magnet-reception well. A bow-string channel gate pin is provided for retaining a bow string in the bow-string-reception channel. First lock pin reception channels are present in the carriage block, and a second lock pin reception channel is present in the bow-string channel gate pin. A gate lock pin is received in the first lock pin reception channels and the second lock pin reception channel for retaining the bow-string channel gate pin in the carriage block.

The arrow launching apparatus also includes an arrow especially adapted for use with the arrow launching apparatus. In this respect, an arrow apparatus includes an arrow shaft which includes a front shaft end and a rear shaft end. A front arrow shaft insert is received in the front shaft end, and a rear arrow shaft insert received in the rear shaft end. A screw-in arrow point is received in the front arrow shaft insert, and a magnetic screw-in rear end is received in the rear arrow shaft insert. A front bushing is sandwiched between the screw-in arrow point and the front arrow shaft insert, and the front bushing has an outer diameter which is greater than the outer diameter of the screw-in arrow point, the front arrow shaft insert, and the arrow shaft. A rear bushing is sandwiched between the magnetic screw-in rear end and the rear arrow shaft insert, and the rear bushing has an outer diameter which is greater than the outer diameter of the magnetic screw-in rear end, the rear arrow shaft insert, and the arrow shaft. The front bushing and the rear bushing are preferably made of relatively low friction material.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bow-attached, arrow launching apparatus which has all of the advantages of the prior art and none of the disadvantages.

It is another object of the present invention to provide a new and improved bow-attached, arrow launching apparatus which may be easily and efficiently manufactured and marketed.

It is a further object of the present invention to provide a new and improved bow-attached, arrow launching apparatus which is of durable and reliable construction.

An even further object of the present invention is to provide a new and improved bow-attached, arrow launching apparatus which is susceptible of a low cost of manufacture with regard to both materials and labor, and which accordingly is then susceptible of low prices of sale to the consuming public, thereby making such bow-attached, arrow launching apparatus available to the buying public.

Still yet a further object of the present invention is to provide a new and improved bow-attached, arrow launching apparatus which permits an arrow to be launched while the bow and arrow are supported by two hands of the user.

Still another object of the present invention is to provide a new and improved bow-attached, arrow launching apparatus that enables a bow string guide assembly to be held in a string-tensed position without the need for a user to maintain full tension on the bow string.

Yet another object of the present invention is to provide a new and improved bow-attached, arrow launching apparatus which provides front guide members and rear guide members which are connected together in a rigid, non-telescopic manner.

Even another object of the present invention is to provide a new and improved bow-attached, arrow launching apparatus that permits assembly of front guide members and rear guide members from a storage condition to be carried out rapidly and securely.

Still a further object of the present invention is to provide a new and improved bow-attached, arrow launching apparatus which permits disassembly of front guide members and rear guide members from an in-use condition to a storage condition to be carried out rapidly.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the bow-attached, arrow launching apparatus of the invention.

FIG. 5 is a cross-sectional view of the embodiment of the invention shown in FIG. 3, taken along line 5—5 of FIG. 3.

FIG. 6 is a view of the embodiment in FIG. 5, wherein the thumb plate is released to release the carriage block to permit the bow string to launch the arrow.

FIG. 9 is a front view of an arrow being supported on the rear guide members of the invention.

FIG. 10 is an exploded side view of an arrow of the invention.

DESCRIPTION OF THE PREFERRED EMBODIMENT

With reference to the drawings, a new and improved bow-attached, arrow launching apparatus embodying the principles and concepts of the present invention will be described.

Figure 1:
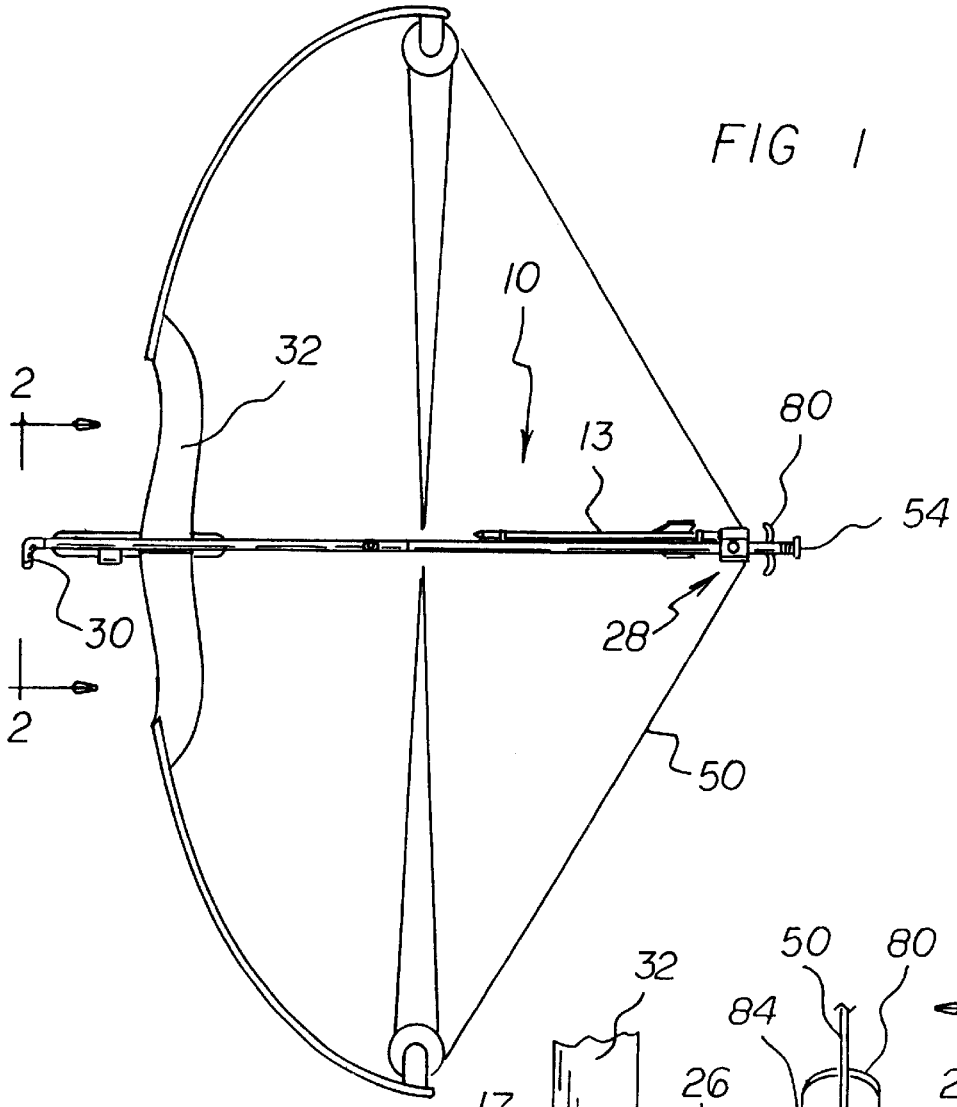
FIG. 1 is a side view showing a preferred embodiment of the improved bow-attached, arrow launching apparatus of the invention, in an extended orientation prior to launching a shorter-than-conventional-length arrow.
Figure 2:
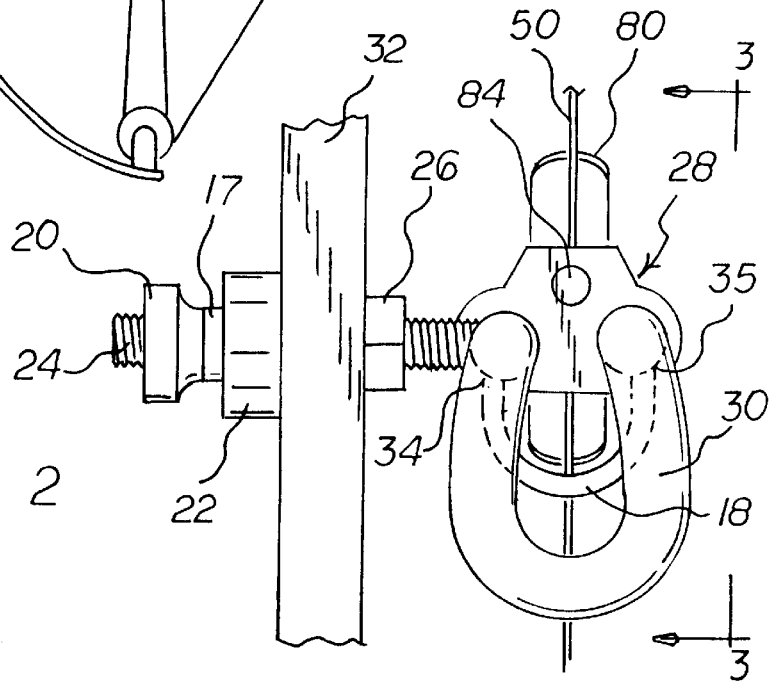
FIG. 2 is an enlarged front view of the portion of the embodiment of the invention shown in FIG. 1, taken along line 2—2 of FIG. 1.
Figure 3:
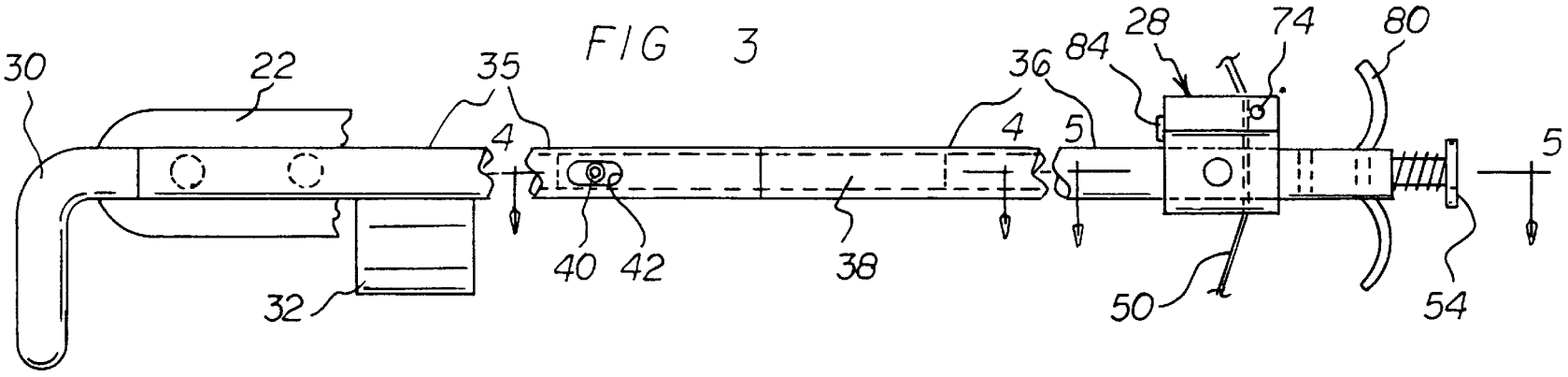
FIG. 3 is an enlarged side view of the embodiment of the invention shown in FIG. 2, taken along line 3—3 of FIG. 2.
Figure 4:
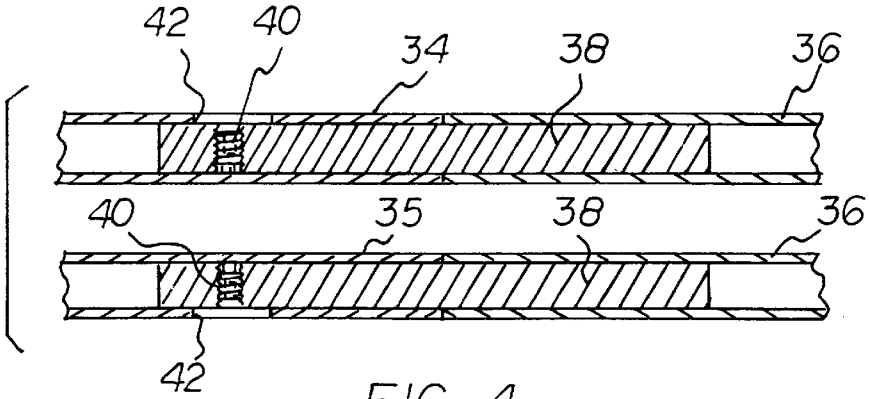
FIG. 4 is a cross-sectional view of the embodiment of the invention shown in FIG. 3, taken along line 4—4 of FIG. 3.
Figure 7:
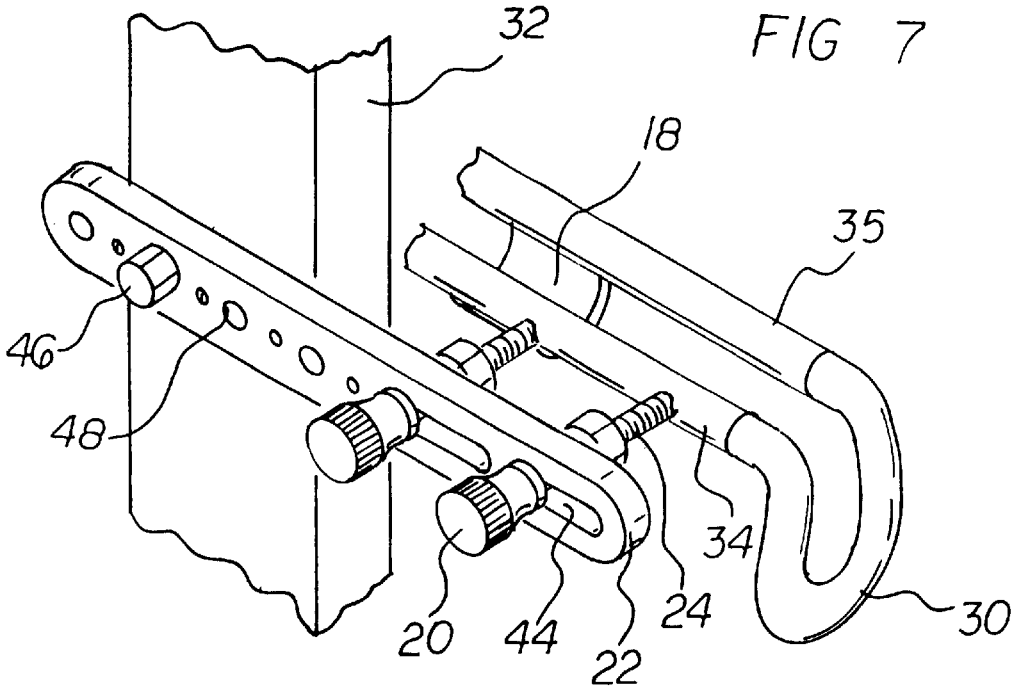
FIG. 7 is a partial perspective view of the front of the launcher-to-bow-handle attachment means.
Figure 8:
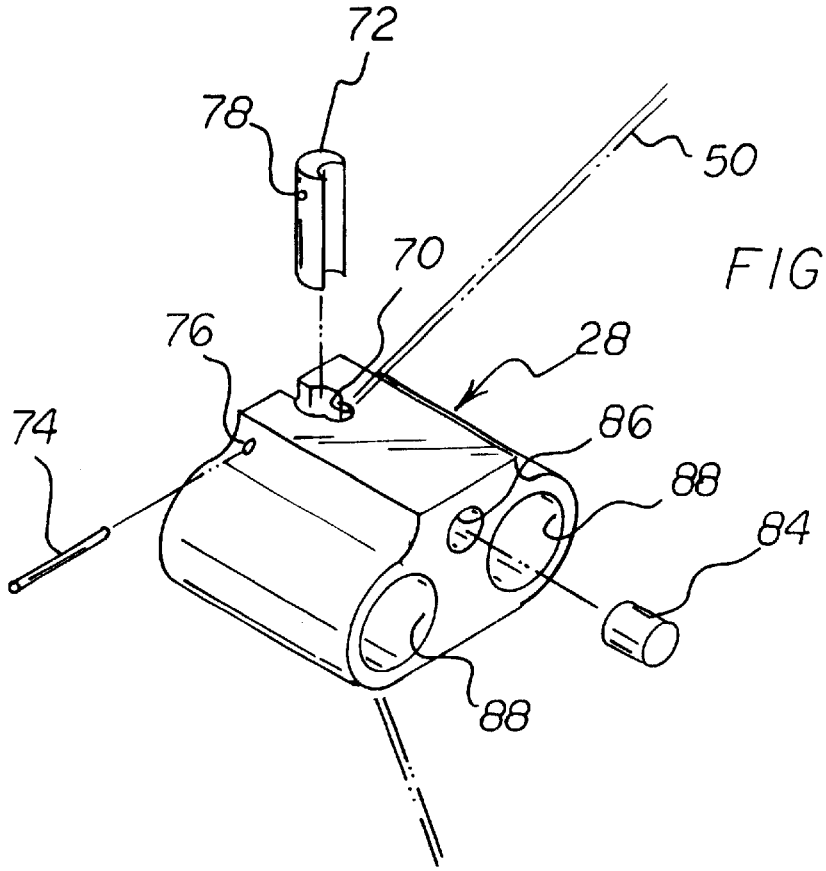
FIG. 8 is an exploded perspective view of the carriage block of the invention.

Turning to FIGS. 1–8, there is shown a preferred embodiment of the bow-attached, arrow launching apparatus of the invention generally designated by reference numeral 10. In the preferred embodiment, a bow-attached, arrow launching apparatus 10 is provided for attachment to a bow handle 32 and includes launcher-to-bow-handle attachment means connected to the bow handle 32. A launcher assembly is connected to the launcher-to-bow-handle attachment means. The launcher assembly includes a guide member assembly and a carriage block 28 supported on the guide member assembly, and the carriage block 28 rides along the guide member assembly. The carriage block 28 includes a bow-string-reception channel 70 for receiving a bow string 50. Carriage block hold and release assembly means are supported on the guide member assembly and provide for selectively preventing or permitting travel of the carriage block 28 along the guide member assembly.

Preferably, the guide member assembly includes threaded studs 24 for attachment to the launcher-to-bow-handle attachment means. The threaded studs 24 can be welded onto the guide member assembly.

Preferably, the launcher-to-bow-handle attachment means include a mounting bar 22 which includes at least one bow-handle-fastener reception channel 48 and two threaded stud reception and adjustment slots 44. A bow-handle-received fastener 46 is threaded through the bow-handle-fastener reception channel 48 for mounting the mounting bar 22 onto the bow handle 32. Thumb nuts 20 are used for attachment to the threaded studs 24 of the guide member assembly which are passed through the threaded stud reception and adjustment slots 44, for securing the threaded studs 24 to the mounting bar 22.

Preferably, the guide member assembly includes a first guide member unit connected to the launcher-to-bow-handle attachment means, a distal end bridging and carriage stopping member 30 connected to the first guide member unit, and a second guide member unit connected to the distal end bridging and carriage stopping member 30. The second guide member unit and the first guide member unit are parallel to each other.

Preferably, the first guide member unit includes the threaded studs 24 for connection to the launcher-to-bow-handle attachment means.

Preferably, the carriage block hold and release assembly means are supported on the respective guide member units, for selectively holding and releasing the carriage block 28 on the respective guide member units.

Preferably, the first guide member unit includes a first front guide member 34, a rear guide member 36, and front-to-rear-guide connecting means for connecting the rear guide member 36 to the first front guide member 34. Preferably, the second guide member unit includes a second front guide member 35, a rear guide member 36, and front-to-rear-guide connecting means for connecting the rear guide member 36 to the second front guide member 35. The first front guide member 34, the second front guide member 35, and the rear guide members 36 have substantially the same outer diameter. In this respect, the first front guide member 34, the second front guide member 35, and the rear guide members 36 provide a smooth guide track surface for an arrow which is launched from the arrow launching apparatus 10 of the invention.

Preferably, a reinforcement member 18 is connected between the first guide member unit and the second guide member unit to stabilize the relationship between the two guide units and to maintain in a parallel relationship.

Preferably, the threaded studs 24, the first front guide member 34, the distal end bridging and carriage stopping member 30, the second front guide member 35, and the reinforcement member 18 form a unified, integrated guide track front assembly.

Preferably, the front-to-rear-guide connecting means include a guide member longitudinal insert 38 received in the first front guide member 34 and in a rear guide member 36 for connecting the rear guide member 36 to the first front guide member 34. Also, another guide member longitudinal insert 38 is received in the second front guide member 35 and in another rear guide member 36 for connecting the other rear guide member 36 to the second front guide member 35. Front-member-to-insert locking means are provided for locking the guide member longitudinal inserts 38 to the respective front guide members. Ends of the respective guide member longitudinal inserts 38 can be press fitted into the respective rear guide members 36.

Preferably, the guide member longitudinal inserts 38, the rear guide members 36, the carriage block 28, and the carriage block hold and release assembly 52 can be formed as a unified, integrated guide track rear extension assembly. The guide track rear extension assembly can be stored on the back side of the bow handle 32 or quiver when the guide track extension assembly is not in use.

Preferably, the front-member-to-insert locking means include front set screw access openings 42 in the respective first front guide member 34 and the second front guide member 35. Front guide member set screws 40 are received in the guide member longitudinal inserts 38 and are accessed through the front set screw access opening 42. One front guide member set screw 40 is used to engage the first front guide member 34, and a second front guide member set screw 40 is used to engage the second front guide member 35.

Preferably, arrow retention means are provided in the carriage block 28. The arrow retention means include a magnet member 84 for engaging a ferro-magnetic rear end of an arrow 13.

Preferably, the carriage block hold and release assembly means include a carriage block hold and release assembly 52 mounted on the guide member assembly and include a carriage holding element reception portion 68 present on the carriage block 28. The carriage holding element reception portion 68 can be in the form of a carriage holding element reception channel 68 in the carriage block 28. The guide member assembly includes a first guide member unit and a second guide member unit, and each respective guide member unit includes a block holding element entry/exit passageway 66.

Preferably, the carriage block hold and release assembly 52 includes a pair of block holding element stops 62 received in the respective guide member units, positioned distal to the block holding element entry/exit passageways 66. A pair of block holding elements 64 are placed adjacent to block holding element entry/exit passageways 66 within the guide member units. A pair of plunger wedges 60 are received in the guide member units, and the plunger wedges 60 are positioned proximal to the block holding element entry/exit passageways 66. A thumb plate 54 is connected to ends of the plunger wedges 60, and the thumb plate 54 is positioned outside the guide member units. A finger hold 80 is connected to the guide member units in proximity of the thumb plate 54. Plunger puller springs 58 are positioned between the thumb plate 54 and the guide member units, providing a spring bias for pulling the plunger wedges 60 in a direction away from the block holding element stops 62. A bridging and carriage stop member 82 is connected to the guide member units between the finger hold 80 and the block holding element entry/exit passageways 66. The carriage stop member 82 limits backward motion of the carriage block 28 along the guide member units. A pair of block holding elements 64 are positioned between the block holding element stops 62 and the plunger wedges 60 adjacent to the block holding element entry/exit passageways 66.

In addition, holding-element-retainer magnets 83 are located in the block holding element stops 62 adjacent to the block holding elements 64 for attracting the block holding elements 64 thereto and for holding the block holding elements 64 against the holding-element-retainer magnets 83.

Preferably, the carriage block 28 includes guide-member-reception channels 88 for receiving the guide member assembly. A magnet-reception well 86 is provided in the carriage block 28, and a magnet member 84 is received in the magnet-reception well 86. A bow-string channel gate pin 72 is provided for retaining a bow string 50 in the bow-string-reception channel 70. First lock pin reception channels 76 are present in the carriage block 28, and a second lock pin reception channel 78 is present in the bow-string channel gate pin 72. A gate lock pin 74 is received in the first lock pin reception channels 76 and the second lock pin reception channel 78 for retaining the bow-string channel gate pin 72 in the carriage block 28.

Turning to FIGS. 9 and 10, the arrow launching apparatus 10 also includes an arrow 13 especially adapted for use with the arrow launching apparatus 10. In this respect, an arrow apparatus includes an arrow shaft 21 which includes a front shaft end 11 and a rear shaft end 14. A front arrow shaft insert 23 is received in the front shaft end 11, and a rear arrow shaft insert 15 received in the rear shaft end 14. A screw-in arrow point 27 is received in the front arrow shaft insert 23, and a magnetic screw-in rear end 29 is received in the rear arrow shaft insert 15. A front bushing 25 is sandwiched between the screw-in arrow point 27 and the front arrow shaft insert 23, and the front bushing 25 has an outer diameter which is greater than the outer diameter of the screw-in arrow point 27, the front arrow shaft insert 23, and the arrow shaft 21. A rear bushing 16 is sandwiched between the magnetic screw-in rear end 29 and the rear arrow shaft insert 15, and the rear bushing 16 has an outer diameter which is greater than the outer diameter of the magnetic screw-in rear end 29, the rear arrow shaft insert 15, and the arrow shaft 21.

The front bushing 25 and the rear bushing 16 are preferably made of relatively low friction material and flexible material. For example, the front bushing 25 and the rear bushing 16 can be made from TEFLON(™) material. When the front bushing 25 is squeezed between the screw-in arrow point 27 and the front arrow shaft insert 23, the outer diameter of the front bushing 25 is increased. Similarly, when the rear bushing 16 is squeezed between the magnetic screw-in rear end 29 and the rear arrow shaft insert 15, the outer diameter of the rear bushing 16 is increased.

Because the respective outer diameters of the front bushing 25 and the rear bushing 16 are larger than the outer diameters of other arrow elements, when the arrow 13 is placed in the launcher assembly, the arrow 13 is supported on the launcher assembly by only two points, the front bushing 25 and the rear bushing 16. As a result, the arrow 13 can move along the launcher assembly relatively rapidly with substantially reduced friction.

To use the embodiment of the invention shown in the drawings, a position on the bow handle 32 is selected, and the bow-handle-received fastener 46 is inserted in a selected bow-handle-fastener reception channel 48 and fastened to the bow handle 32. Then, the threaded studs 24 of the guide track front assembly are inserted though the threaded stud reception and adjustment slots 44 on the mounting bar 22. Positions along the longitudinal axis of the mounting bar 22 are selected, and the guide track front assembly is secured to the mounting bar 22 by tightening thumb nuts 20 and locking nuts 26 on opposite sides of the mounting bar 22. Washers 17 can be located between the thumb nuts 20 and the mounting bar 22.

When the arrow launching apparatus 10 of the invention is not needed, the guide track front assembly can be mounted on the bow handle 32 without mounting the guide track rear extension assembly to the guide track front assembly. The guide track front assembly can be retained on a mounting bracket on the bow handle 32 or on a quiver mounted on the bow handle 32 until it is needed.

When the arrow launching apparatus 10 of the invention is to be used, the guide track rear extension assembly is removed from the bow handle 32, and the bow string 50 must be positioned in the carriage block 28. To do so, the gate lock pin 74 is removed from the first lock pin reception channels 76 and the second lock pin reception channel 78, and the bow-string channel gate pin 72 is lifted out from the bow-string-reception channel 70 at the rear of the carriage block 28. Then, the carriage block 28 is moved toward the bow string 50 so that the bow string 50 enters the bow-string-reception channel 70. Then, the bow-string channel gate pin 72 is replaced in the carriage block 28, and the gate lock pin 74 is threaded back through the first lock pin reception channels 76 and the second lock pin reception channel 78. In this way, the bow-string-reception channel 70 surrounds the bow string 50 and permits free movement of the bow string 50 through the carriage block 28.

Then, the carriage block 28 is mounted on the guide track rear extension assembly by threading the guide-member-reception channels 88 over the rear guide members 36 so that the bow string 50 is at the rear of the carriage block 28.

Then, the guide member longitudinal inserts 38 are inserted into the first front guide member 34 and the second front guide member 35. In this way, the free ends of the first and second front guide members 34,35 are placed flush against the free ends of the rear guide members 36, so that the front guide members 34,35 and the rear guide members 36 form a smooth, continuous guide track. Then, the respective front guide member set screws 40 are accessed through the respective front set screw access openings 42, and the front guide member set screws 40 are tightened. The front guide member set screws 40 can have Allen heads, and an Allen wrench can be used to tighten the front guide member set screws 40. Once the front guide member set screws 40 are tightened, the guide track front assembly and the guide track rear extension assembly are secured together to provide a fully assembled arrow launching apparatus 10 of the invention.

To use the arrow launching apparatus 10 to launch an arrow 13, the user holds the bow handle 32 with a first hand. With the second hand, the user places an arrow 13 on the guide member units and places the magnetic rear end 29 of the arrow 13 next to the magnet member 84 in the carriage block 28. As a result, the two magnets attract each other, and the arrow 13 is magnetically attached to the carriage block 28. Such a magnetic attachment between the arrow 13 and the carriage block 28 keeps the arrow 13 is proper alignment on the arrow launching apparatus 10 and removes the time-consuming need for an arrow notch (or nock) to receive the bow string 50. In this respect, using the arrow 13 and the carriage block 28 speeds up the step of mounting the arrow 13 in the arrow launching apparatus 10.

Once the arrow 13 and the carriage block 28 are magnetically joined, with the second hand, the user grasps the carriage block 28 and pulls the carriage block 28 back towards the user. As this occurs, the bow string 50 is being tensed, the arrow 13 and the carriage block 28 are pulled back towards the user as the guide-member-reception channels 88 ride along the front and rear guide members, and the bow string 50 slides freely in the bow-string-reception channel 70 of the carriage block 28. When the carriage block 28 reaches the bridging and carriage stop member 82, the carriage block hold and release assembly 52 can be used.

More specifically, when the carriage block 28 is pulled back to reach the bridging and carriage stop member 82, the block holding elements 64 are in registration with the block holding element entry/exit passageways 66 in the rear guide members 36. Then, with the thumb of the second hand, the user presses the thumb plate 54 toward the block holding elements 64, as shown by arrow 12 in FIG. 5. When this occurs, the bias of plunger puller springs 58 is overcome, the plunger wedges 60 are pushed in the direction of arrow 12, and the wedge ends of the plunger wedges 60 push the block holding elements 64 through the block holding element entry/exit passageways 66 to contact the carriage holding element reception portion 68 in the carriage block 28. When this is done, the carriage block 28 and the bow string 50 are held by the carriage block hold and release assembly 52.

The user can place two fingers of the second hand on the finger hold 80 and have one's thumb on the thumb plate 54 to facilitate applying pressure in the direction of arrow 12 to continue to hold the carriage block 28 by the block holding elements 64. The amount of strength and effort to hold the carriage block 28 and the bow string 50 with the carriage block hold and release assembly 52 is much less than the strength and effort required to keep the carriage block 28 and the bow string 50 is a tensed position if the carriage block hold and release assembly 52 were not present.

With the user holding the bow handle 32 with the first hand, with the user holding the finger hold 80 and the thumb plate 54 with the second hand, with the carriage block hold and release assembly 52 in-use for holding the carriage block 28, with the arrow 13 and the bow string 50 in a ready-to-shoot condition, and with the user pressing the thumb plate 54 inward with the second hand, the user takes aim on a target.

When the user is ready to shoot the arrow 13, with the target in aim, the user carefully lifts one's thumb of the second hand in a direction away from the thumb plate 54, as shown by directional arrow 19 in FIG. 6, while still holding the finger hold 80 with fingers of the second hand. As a result, the bow and arrow 13 and the arrow launching apparatus 10 are supported by both the first and second hands as the plunger puller springs 58 pull back on the plunger wedges 60, permitting the carriage block 28 under tension from the bow string 50, to move forward, pushing the block holding elements 64 back through the block holding element entry/exit passageways 66 and permitting the carriage block 28 to slide forward under tension of the bow string 50. In this way, the arrow 13 is propelled forward along the guide member units. When the carriage block 28 reaches the distal end bridging and carriage stopping member 30, the carriage block 28 is stopped from further forward movement, and the arrow 13 is launched off of the arrow launching apparatus 10 of the invention. At launching of the arrow 13, the relatively small attractive force between the magnetic rear end of the arrow 13 and the magnet member 84 of the carriage block 28 is easily overcome by the momentum of the arrow 13 rapidly moving along the arrow launching apparatus 10 when the carriage block 28 is stopped.

When the arrow launching apparatus 10 is no longer needed, the arrow launching apparatus 10 is disassembled, and the disassembled apparatus can be stored on a mounting bracket on the bow handle 32 or on a quiver mounted on the bow handle 32 until it is needed again.

The first front guide member 34, the second front guide member 35, and the rear guide members 36 can be made from metal tubes, such as ⅜ inch diameter tubes.

The arrow launching apparatus 10 of the invention can be made in any convenient length. Preferably, the guide member units are longer than 30 inches so that the apparatus can be used for launching arrows up to 30 inches long. Moreover, the arrow launching apparatus 10 permits launching of short arrows, that is arrows that are shorter than the distance between the bow handle 32 and the tensed bow string 50. In this respect, the arrow launching apparatus 10 can be used with arrows that are 7 inches and 10 inches long.

In general, the components of the bow-attached, arrow launching apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bow-attached, arrow launching apparatus that is low in cost, relatively simple in design and operation, and which may advantageously be used to permit an arrow to be launched while the bow and arrow are supported by two hands of the user. With the invention, a bow-attached, arrow launching apparatus is provided which enables a bow string guide assembly to be held in a string-tensed position without the need for a user to maintain full tension on the bow string. With the invention, a bow-attached, arrow launching apparatus provides front guide members and rear guide members which are connected together in a rigid, non-telescopic manner. With the invention, a bow-attached, arrow launching apparatus is provided which permits assembly of front guide members and rear guide members from a storage condition to be carried out rapidly and securely. With the invention, a bow-attached, arrow launching apparatus is provided which permits disassembly of front guide members and rear guide members from an in-use condition to a storage condition to be carried out rapidly.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An arrow launching apparatus for attachment to a bow handle, comprising:

launcher-to-bow-handle attachment means connected to the bow handle, a launcher assembly connected to said launcher-to-bow-handle attachment means, wherein said launcher assembly includes a guide member assembly and a carriage block supported on said guide member assembly, wherein said carriage block rides along said guide member assembly, and wherein said carriage block includes a bow-string-reception channel for receiving a bow string, and carriage block hold and release assembly means, supported on said guide member assembly, for selectively preventing or permitting travel of said carriage block along said guide member assembly.

2. The apparatus of claim 1 wherein said guide member assembly includes threaded studs for attachment to said launcher-to-bow-handle attachment means.

3. The apparatus of claim 1 wherein said launcher-to-bow-handle attachment means include:

a mounting bar which includes a bow-handle-fastener reception channel and a threaded stud reception and adjustment slots, a bow-handle-received fastener, which is threaded through said bow-handle-fastener reception channel, for mounting said mounting bar onto the bow handle, and thumb nuts for attachment to said threaded studs of said guide member assembly which are passed through said threaded stud reception and adjustment slots, for securing said threaded studs to said mounting bar.

4. The apparatus of claim 1 wherein said guide member assembly includes:

a first guide member unit connected to said launcher-to-bow-handle attachment means, a distal end bridging and carriage stopping member connected to said first guide member unit, and a second guide member unit connected to said distal end bridging and carriage stopping member, wherein said second guide member unit and said first guide member unit are parallel to each other.

5. The apparatus of claim 4 wherein said first guide member unit includes threaded studs for connection to said launcher-to-bow-handle attachment means.

6. The apparatus of claim 4 wherein said carriage block hold and release assembly means are supported on said respective guide member units, for selectively holding and releasing said carriage block on said respective guide member units.

7. The apparatus of claim 4 wherein:

said first guide member unit includes a first front guide member, a rear guide member, and front-to-rear-guide connecting means for connecting said rear guide member to said first front guide member, and said second guide member unit includes a second front guide member, a rear guide member, and front-to-rear-guide connecting means for connecting said rear guide member to said second front guide member, wherein said first front guide member, said second front guide member, and said rear guide members have substantially the same outer diameter.

8. The apparatus of claim 7, further including:

a reinforcement member connected between said first guide member unit and said second guide member unit.

9. The apparatus of claim 7 wherein said threaded studs, said first front guide member, said distal end bridging and carriage stopping member, said second front guide member, and said reinforcement member form a unified, integrated guide track front assembly.

10. The apparatus of claim 7 wherein said front-to-rear-guide connecting means include:

a guide member longitudinal insert received in said first front guide member and in a rear guide member for connecting said rear guide member to said first front guide member, a guide member longitudinal insert received in said second front guide member and in another rear guide member for connecting said other rear guide member to said second front guide member, and front-member-to-insert locking means for locking said guide member longitudinal inserts to said respective front guide members.

11. The apparatus of claim 10 wherein said guide member longitudinal inserts, said rear guide members, said carriage block, and said carriage block hold and release assembly can be formed as a unified, integrated guide track rear extension assembly.

12. The apparatus of claim 10 wherein said front-member-to-insert locking means include:

front set screw access openings in said respective first front guide member and said second front guide member, and front guide member set screws, received in said guide member longitudinal inserts and accessed through said front set screw access opening, for engaging said first front guide member and said second front guide member.

13. The apparatus of claim 1, further including arrow retention means in said carriage block.

14. The apparatus of claim 13 wherein said arrow retention means include a magnet member for engaging a ferromagnetic rear end of an arrow.

15. The apparatus of claim 1 wherein said carriage block hold and release assembly means include:

a carriage block hold and release assembly mounted on said guide member assembly, and a carriage holding element reception portion on said carriage block.

16. The apparatus of claim 1 wherein said guide member assembly includes a first guide member unit and a second guide member unit, and wherein each respective guide member unit includes a block holding element entry/exit passageway.

17. The apparatus of claim 16 wherein said carriage block hold and release assembly includes:

a pair of block holding element stops received in said respective guide member units, positioned distal to said block holding element entry/exit passageways, a pair of block holding elements placed adjacent to block holding element entry/exit passageways within said guide member units, a pair of plunger wedges received in said guide member units, positioned proximal to said block holding element entry/exit passageway, a thumb plate connected to ends of said plunger wedges, positioned outside said guide member units, a finger hold connected to said guide member units in proximity of said thumb plate, plunger puller springs positioned between said thumb plate and said guide member units, providing a spring bias for pulling said plunger wedges in a direction away from said block holding element stops, a bridging and carriage stop member, connected to said guide member units between said finger hold and said block holding element entry/exit passageways, for limiting backward motion of said carriage block along said guide member units, and a pair of block holding elements positioned between said block holding element stops and said plunger wedges adjacent to said block holding element entry/exit passageways.

18. The apparatus of claim 17, further including:

holding-element-retainer magnets located in said block holding element stops adjacent to said block holding elements for attracting said block holding elements thereto and for holding said block holding elements against said holding-element-retainer magnets.

19. The apparatus of claim 1 wherein said carriage block includes:

guide-member-reception channels for receiving said guide member assembly, a magnet-reception well and a magnet member received in said magnet-reception well, a bow-string channel gate pin for retaining a bow string in said bow-string-reception channel, first lock pin reception channels, a second lock pin reception channel in said bow-string channel gate pin, and a gate lock pin received in said first lock pin reception channels and said second lock pin reception channel for retaining said bow-string channel gate pin in said carriage block.

20. The apparatus of claim 1, further including an arrow apparatus, comprising:

an arrow shaft which includes a front shaft end and a rear shaft end, a front arrow shaft insert received in said front shaft end, a rear arrow shaft insert received in said rear shaft end, a screw-in arrow point received in said front arrow shaft insert, a magnetic screw-in rear end received in said rear arrow shaft insert, a front bushing sandwiched between said screw-in arrow point and said front arrow shaft insert, wherein said front bushing has an outer diameter which is greater than the outer diameter of said screw-in arrow point, said front arrow shaft insert, and said arrow shaft, and a rear bushing sandwiched between said magnetic screw-in rear end and said rear arrow shaft insert, wherein said rear bushing has an outer diameter which is greater than the outer diameter of said magnetic screw-in rear end, said rear arrow shaft insert, and said arrow shaft.

21. An arrow apparatus, comprising:

an arrow shaft which includes a front shaft end and a rear shaft end, a front arrow shaft insert received in said front shaft end, a rear arrow shaft insert received in said rear shaft end, a screw-in arrow point received in said front arrow shaft insert, a magnetic screw-in rear end received in said rear arrow shaft insert, a front bushing sandwiched between said screw-in arrow point and said front arrow shaft insert, wherein said front bushing has an outer diameter which is greater than the outer diameter of said screw-in arrow point, said front arrow shaft insert, and said arrow shaft, and a rear bushing sandwiched between said magnetic screw-in rear end and said rear arrow shaft insert, wherein said rear bushing has an outer diameter which is greater than the outer diameter of said magnetic screw-in rear end, said rear arrow shaft insert, and said arrow shaft.

22. The apparatus of claim 21 wherein said front bushing and said rear bushing are made of relatively low friction material.

* * * * *